US009485589B2

(12) United States Patent
Fitz

(10) Patent No.: US 9,485,589 B2
(45) Date of Patent: Nov. 1, 2016

(54) ENHANCED DYNAMICS PROCESSING OF STREAMING AUDIO BY SOURCE SEPARATION AND REMIXING

(71) Applicant: Starkey Laboratories, Inc., Eden Prairie, MN (US)

(72) Inventor: Kelly Fitz, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 236 days.

(21) Appl. No.: 13/725,443

(22) Filed: Dec. 21, 2012

(65) Prior Publication Data

US 2013/0108096 A1 May 2, 2013

Related U.S. Application Data

(63) Continuation-in-part of application No. 12/474,881, filed on May 29, 2009, now Pat. No. 8,705,751.

(60) Provisional application No. 61/058,101, filed on Jun. 2, 2008.

(51) Int. Cl.
*H04R 25/00* (2006.01)
*H04S 1/00* (2006.01)

(52) U.S. Cl.
CPC ..... *H04R 25/43* (2013.01); *H04R 25/356* (2013.01); *H04R 25/552* (2013.01); *H04R 2225/43* (2013.01); *H04S 1/005* (2013.01); *H04S 2420/01* (2013.01)

(58) Field of Classification Search
USPC ..... 381/17, 8, 23.1
See application file for complete search history.

(56) References Cited

U.S. PATENT DOCUMENTS

| | | | |
|---|---|---|---|
| 4,406,001 | A | 9/1983 | Klasco et al. |
| 4,996,712 | A | 2/1991 | Laurence et al. |
| 5,785,661 | A | 7/1998 | Shennib |
| 5,825,894 | A | 10/1998 | Shennib |
| 6,118,875 | A | 9/2000 | Møller et al. |
| 6,405,163 | B1 | 6/2002 | Laroche |

(Continued)

FOREIGN PATENT DOCUMENTS

| | | | |
|---|---|---|---|
| DE | 102006047983 | A1 | 4/2008 |
| DE | 102006047986 | A1 | 4/2008 |

(Continued)

OTHER PUBLICATIONS

"U.S. Appl. No. 11/935,935 , Response filed Jun. 5, 2013 to Final Office Action mailed Dec. 6, 2012", 14 pgs.

(Continued)

*Primary Examiner* — Lynne Gurley
*Assistant Examiner* — Vernon P Webb
(74) *Attorney, Agent, or Firm* — Schwegman Lundberg & Woessner, P.A.

(57) ABSTRACT

This application relates to a systems and methods for enhanced dynamics processing of streaming audio by source separation and remixing for hearing assistance devices, according to one example. In one embodiment, an external streaming audio device processes sources isolated from an audio signal using source separation, and mixes the resulting signals back into the unprocessed audio signal to enhance individual sources while minimizing audible artifacts. Variations of the present system use source separation in a side chain to guide processing of a composite audio signal.

20 Claims, 8 Drawing Sheets

(56) References Cited

U.S. PATENT DOCUMENTS

| | | | | |
|---|---|---|---|---|
| 6,424,721 | B1 * | 7/2002 | Hohn | 381/313 |
| 6,840,908 | B2 | 1/2005 | Edwards et al. | |
| 7,280,664 | B2 | 10/2007 | Fosgate et al. | |
| 7,330,556 | B2 | 2/2008 | Kates | |
| 7,340,062 | B2 | 3/2008 | Revit et al. | |
| 7,409,068 | B2 | 8/2008 | Ryan et al. | |
| 8,243,969 | B2 | 8/2012 | Breebaart et al. | |
| 8,266,195 | B2 | 9/2012 | Taleb et al. | |
| 8,638,946 | B1 | 1/2014 | Mahabub | |
| 8,705,751 | B2 | 4/2014 | Edwards | |
| 9,009,057 | B2 | 4/2015 | Breebaart et al. | |
| 9,031,242 | B2 | 5/2015 | Edwards et al. | |
| 2001/0040969 | A1 | 11/2001 | Revit et al. | |
| 2001/0046304 | A1 * | 11/2001 | Rast | H04R 1/1041 381/74 |
| 2002/0078817 | A1 | 6/2002 | Date | |
| 2003/0169891 | A1 * | 9/2003 | Ryan et al. | 381/92 |
| 2004/0190734 | A1 | 9/2004 | Kates | |
| 2005/0135643 | A1 | 6/2005 | Lee et al. | |
| 2006/0034361 | A1 | 2/2006 | Choi | |
| 2006/0050909 | A1 | 3/2006 | Kim et al. | |
| 2006/0083394 | A1 | 4/2006 | McGrath | |
| 2007/0076902 | A1 | 4/2007 | Master | |
| 2007/0287490 | A1 * | 12/2007 | Green | G10H 1/0008 455/523 |
| 2007/0297626 | A1 | 12/2007 | Revit et al. | |
| 2008/0205664 | A1 * | 8/2008 | Kim et al. | 381/77 |
| 2009/0043591 | A1 | 2/2009 | Breebaart | |
| 2009/0116657 | A1 * | 5/2009 | Edwards | H04R 25/552 381/60 |
| 2009/0182563 | A1 | 7/2009 | Schobben et al. | |
| 2009/0296944 | A1 | 12/2009 | Edwards | |
| 2010/0040135 | A1 | 2/2010 | Yoon et al. | |
| 2011/0286618 | A1 | 11/2011 | Vandali et al. | |
| 2013/0148813 | A1 | 6/2013 | Strelcyk et al. | |
| 2014/0226825 | A1 | 8/2014 | Edwards | |

FOREIGN PATENT DOCUMENTS

| | | | |
|---|---|---|---|
| EP | 1531650 | A2 | 5/2005 |
| EP | 1655998 | A2 | 5/2006 |
| EP | 1796427 | A1 | 6/2007 |
| EP | 1895515 | A1 | 3/2008 |
| EP | 2131610 | A1 | 12/2009 |
| EP | 1236377 | B1 | 11/2011 |
| WO | WO-0124577 | A1 | 4/2001 |
| WO | WO-0176321 | A1 | 10/2001 |
| WO | WO-2007041231 | A2 | 4/2007 |
| WO | WO-2007096808 | A1 | 8/2007 |
| WO | WO-2007106553 | A1 | 9/2007 |
| WO | WO-2011100802 | A1 | 8/2011 |

OTHER PUBLICATIONS

"U.S. Appl. No. 11/935,935, Advisory Action mailed May 23, 2012", 3 pgs.
"U.S. Appl. No. 11/935,935, Examiner Interview Summary mailed Apr. 12, 2013", 3 pgs.
"U.S. Appl. No. 11/935,935, Final Office Action mailed Jan. 31, 2012", 10 pgs.
"U.S. Appl. No. 11/935,935, Final Office Action mailed Dec. 6, 2012", 10 pgs.
"U.S. Appl. No. 11/935,935, Non Final Office Action mailed Jun. 27, 2011", 9 pgs.
"U.S. Appl. No. 11/935,935, Non Final Office Action mailed Jul. 5, 2012", 11 pgs.
"U.S. Appl. No. 11/935,935, Non Final Office Action mailed Jul. 17, 2013", 17 pgs.
"U.S. Appl. No. 11/935,935, Response filed Apr. 30, 2012 to Final Office Action mailed Jan. 31, 2012", 10 pgs.
"U.S. Appl. No. 11/935,935, Response filed May 31, 2012 to Advisory Action mailed May 23, 2012", 11 pgs.
"U.S. Appl. No. 11/935,935, Response filed Oct. 27, 2011 to Non Final Office Action mailed Jun. 27, 2011", 8 pgs.
"U.S. Appl. No. 11/935,935, Response filed Nov. 5, 2012 to Non Final Office Action mailed Jul. 5, 2012", 13 pgs.
"U.S. Appl. No. 12/474,881, Final Office Action mailed Jun. 21, 2012", 9 pgs.
"U.S. Appl. No. 12/474,881, Non Final Office Action mailed Jan. 13, 2012", 11 pgs.
"U.S. Appl. No. 12/474,881, Notice of Allowance mailed Sep. 4, 2013", 9 pgs.
"U.S. Appl. No. 12/474,881, Response filed Jun. 13, 2012 to Non Final Office Action mailed Jan. 13, 2012", 8 pgs.
"U.S. Appl. No. 12/474,881, Response filed Dec. 20, 2012 to Final Office Action mailed Jun. 21, 2012", 6 pgs.
"U.S. Appl. No. 12/474,881, Response filed Dec. 30, 2011 to Restriction Requirement mailed Nov. 30, 2011", 7 pgs.
"U.S. Appl. No. 12/474,881, Restriction Requirement mailed Nov. 30, 2011", 7 pgs.
"European Application Serial No. 08253607.9, Office Action mailed Mar. 19, 2010", 1 pg.
"European Application Serial No. 08253607.9, Office Action Response Filed Sep. 22, 2010", 12 pgs.
"European Application Serial No. 08253607.9, Office Action Response filed Nov. 16, 2011", 11 pgs.
"European Application Serial No. 08253607.9, Search Report mailed Aug. 11, 2009", 9 pgs.
"European Application Serial No. 08253607.9; Office Action mailed May 9, 2011", 9 Pgs.
"European Application Serial No. 09161628.4, Communication of a Notice of Opposition mailed May 23, 2011", 15 pgs.
"European Application Serial No. 09161628.4, Communication of Notice of Opposition mailed May 23, 2011", 15 pgs.
"European Application Serial No. 09161628.4, European Search Report mailed Jul. 29, 2009", 3 pgs.
"European Application Serial No. 09161628.4, Extended European Search Report mailed Aug. 5, 2009", 4 pgs.
"European Application Serial No. 09161628.4, Letter from the Opponent mailed Sep. 16, 2013", 6 pgs.
"European Application Serial No. 09161628.4, Response filed Jan. 6, 2012 to Notice of Opposition mailed Jun. 21, 2011", 14 pgs.
"European Application Serial No. 09161628.4, Response filed Feb. 11, 2010 to European Search Report mailed Aug. 5, 2009", 3 pgs.
"European Application Serial No. 09161628.4, Response filed Sep. 16, 2013 to Summons to Attend Oral Proceedings mailed Mar. 7, 2013", 48 pgs.
"European Application Serial No. 09161628.4, Summons to Attend Oral Proceedings mailed Mar. 7, 2013", 13 pgs.
Stone, Michael A., et al., "Effects of spectro-temporal modulation changes produced by multi-channel compression on intelligibility in a competing-speech task.", J Acoust Soc Am., 123(2), (Feb. 2008), 1063-76.
"U.S. Appl. No. 11/935,935, Advisory Action mailed May 14, 2014", 3 pgs.
"U.S. Appl. No. 11/935,935, Decision on Pre-Appeal Brief Request mailed Jul. 21, 2014", 3 pgs.
"U.S. Appl. No. 11/935,935, Pre-Appeal Brief filed Jun. 2, 2014", 5 pgs.
"U.S. Appl. No. 11/935,935, Response filed May 2, 2014 to Final Office Action mailed Jan. 2, 2014", 16 pgs.
"European Application Serial No. 08253607.9, Response filed May 14, 2014 to Office Action mailed Jan. 14, 2014", 16 pgs.
"European Application Serial No. 09161628.4, Office Action mailed Mar. 26, 2013", 10 pgs.
"European Application Serial No. 09161628.4, Reply to Appeal filed Aug. 11, 2014", 69 pgs.
"European Application Serial No. 13198739.8, Extended European Search Report mailed Mar. 27, 2014", 5 pgs.
Bochler, M, et al., "Sound classification in hearing aids inspired by auditory scene", Eurasip Journal of Applied Signal, Processing, Hindawi Publishing Co., Cuyahoga Falls, OH, US, vol. 2005, No. 18, (Oct. 15, 2005), 2991-3002.
Robjohns, Hugh, "How & When to Use Mixed Compression", Sound on Sound, [Online]. Retrieved from the Internet:

(56) References Cited

OTHER PUBLICATIONS

<URL:http://www.soundonsound.com/sos/Jun99/articles/mIxcomp.htm>, (Jun. 1999), 11 pgs.
"U.S. Appl. No. 11/935,935, Final Office Action mailed Jan. 2, 2014", 17 pgs.
"U.S. Appl. No. 11/935,935, Response filed Nov. 18, 2013 to Non Final Office Action mailed Jul. 17, 2013", 15 pgs.
"U.S. Appl. No. 12/474,881, Notice of Allowance mailed Nov. 15, 2013", 7 pgs.
"European Application Serial No. 08253607.9, Office Action mailed Jan. 14, 2014", 6 pgs.
"European Application Serial No. 09161628.4, Communication of Further Notices of Opposition mailed Jun. 27, 2011", 2 pgs.
"European Application Serial No. 09161628.4, Decision Rejecting the Opposition mailed Nov. 21, 2013", 22 pgs.
"European Application Serial No. 09161628.4, Letter Regarding the Opposition filed Jun. 26, 2012", 6 pgs.
"U.S. Appl. No. 11/935,935, PTO Response to Rule 312 Communication mailed Apr. 8, 2015", 2 pgs.
"U.S. Appl. No. 11/935,935, Appeal Brief filed Aug. 21, 2014", 25 pgs.
"U.S. Appl. No. 11/935,935, Corrected Notice of Allowance mailed Feb. 5, 2015", 2 pgs.
"U.S. Appl. No. 11/935,935, Notice of Allowance mailed Dec. 26, 2014", 11 pgs.
"U.S. Appl. No. 13/568,618, Non Final Office Action mailed Mar. 24, 2015", 6 pgs.
"U.S. Appl. No. 14/255,753, Preliminary Amendment filed Aug. 26, 2014", 7 pgs.
"European Application Serial No. 13178787.1, Extended European Search Report mailed Feb. 5, 2015", 7 pgs.
"European Application Serial No. 13198739.8, Response filed May 1, 2015 to Extended European Search Report mailed Mar. 27, 2014", 10 pgs.
"U.S. Appl. No. 13/568,618, Notice of Allowance mailed Jul. 8, 2015", 9 pgs.
"U.S. Appl. No. 13/568,618, Response filed Jun. 24, 2015 to Non Final Office Action mailed Mar. 24, 2015", 7 pgs.
"European Application Serial No. 13178787.1, Communication Pursuant to Rules 70(2) and 70a(2) EPC mailed Mar. 16, 2015", 3 pgs.
"European Application Serial No. 13178787.1, Response filed Sep. 10, 2015 to Extended European Search Report and Communication Pursuant to Rules 70(2) and 70a(2) EPC mailed Feb. 5, 2015 and Mar. 16, 2015", 27 pgs.
"U.S. Appl. No. 14/255,753, Notice of Allowance mailed Jan. 5, 2016", 10 pgs.
U.S. Appl. No. 11/935,935, filed Nov. 6, 2007, Simulated Surround Sound Hearing Aid Fitting System.
U.S. Appl. No. 12/474,881, filed May 29, 2009, Compression and Mixing for Hearing Assistance Devices.
U.S. Appl. No. 13/568,618, filed Aug. 7, 2012, Compression of Spaced Sources for Hearing Assistance Devices.
U.S. Appl. No. 14/255,753, filed Apr. 17, 2014, Compression and Mixing for Hearing Assistance Devices.
U.S. Appl. No. 14/708,718, filed May 11, 2015, Simulated Surround Sound Hearing Aid Fitting System.

* cited by examiner

ENHANCED DYNAMICS PROCESSING OF STREAMING AUDIO BY SOURCE SEPARATION AND REMIXING

CLAIM OF PRIORITY

The present application is a Continuation-in-Part (CIP) of and claims the benefit of priority under 35 U.S.C. §120 to U.S. application Ser. No. 12/474,881, filed May 29, 2009, and titled COMPRESSION AND MIXING FOR HEARING ASSISTANCE DEVICES, which claims the benefit of priority under 35 U.S.C. §119(e) to U.S. Provisional Patent Application Ser. No. 61/058,101, filed on Jun. 2, 2008, the benefit of priority of each of which is claimed hereby, and each of which are incorporated by reference herein in its entirety. The present application is related to U.S. application Ser. No. 13/568,618, filed Aug. 7, 2012, and titled COMPRESSION OF SPACED SOURCES FOR HEARING ASSISTANCE DEVICES, which is incorporated by reference herein in its entirety.

FIELD OF THE INVENTION

This patent application pertains to apparatus and processes enhanced dynamics processing of streaming audio by source separation and remixing for hearing assistance devices.

BACKGROUND

Hearing assistance devices, such as hearing aids, include electronic instruments worn in or around the ear that compensate for hearing losses by amplifying and processing sound. The electronic circuitry of the device is contained within a housing that is commonly either placed in the external ear canal and/or behind the ear. Transducers for converting sound to an electrical signal and vice-versa may be integrated into the housing or external to it.

Whether due to a conduction deficit or sensorineural damage, hearing loss in most patients occurs non-uniformly over the audio frequency range, most commonly at high frequencies. Hearing aids may be designed to compensate for such hearing deficits by amplifying received sound in a frequency-specific manner, thus acting as a kind of acoustic equalizer that compensates for the abnormal frequency response of the impaired ear. Adjusting a hearing aid's frequency specific amplification characteristics to achieve a desired level of compensation for an individual patient is referred to as fitting the hearing aid. One common way of fitting a hearing aid is to measure hearing loss, apply a fitting algorithm, and fine-tune the hearing aid parameters.

Hearing assistance devices also use a dynamic range adjustment, called dynamic range compression, which controls the level of sound sent to the ear of the patient to normalize the loudness of sound in specific frequency regions. The gain that is provided at a given frequency is controlled by the level of sound in that frequency region (the amount of frequency specificity is determined by the filters in the multiband compression design). When properly used, compression adjusts the level of a sound at a given frequency such that its loudness is similar to that for a normal hearing person without a hearing aid. There are other fitting philosophies, but they all prescribe a certain gain for a certain input level at each frequency. It is well known that the application of the prescribed gain for a given input level is affected by time constants of the compressor. What is less well understood is that the prescription can break down when there are two or more simultaneous sounds in the same frequency region. The two sounds may be at two different levels, and therefore each should receive different gain for each to be perceived at their own necessary loudness. Because only one gain value can be prescribed by the hearing aid, however, at most one sound can receive the appropriate gain, providing the second sound with the less than desired sound level and resulting loudness.

This phenomenon is illustrated in the following figures. FIG. 1 shows the levels of two different sounds out of a filter centered at 1 kHz—in this example, the two sounds are two different speech samples. The samples are overlaid on FIG. 1 and one is in a thick dark line 1 and the second is in a thin line 2.

FIG. 2 shows the gains that would be applied to those two different sounds at 1 kHz if they were to be presented to a hypothetical multiband dynamic range compressor. Notice that the ideal gain for each speech sample is different. Again, the samples from the thick dark line 1 are shown in comparison to those of the thin line 2.

FIG. 3 shows the two gains from FIG. 1 represented by the thick dark line 1 and the thin line 2, but with a line of intermediate thickness 3 which shows the gain that is applied when the two sounds are mixed together before being sent to the multiband compressor. Notice that when the two sounds are mixed together, neither receives the exact gain that should be prescribed for each separately; in fact, there are times when the gain should be high for one speech sample, but it is low because the gain is controlled by the level of the mix of the two sounds, not the level of each sound individually. This can cause artificial envelope fluctuations in each sound, described as comodulation or cross modulation by Stone and Moore (Stone, M. A., and Moore, B. C. (2008). "Effects of spectro-temporal modulation changes produced by multi-channel compression on intelligibility in a competing-speech task," J Acoust Soc Am 123, 1063-1076.)

This could be particularly problematic with music and other acoustic sound mixes such as the soundtrack to a Dolby 5.1 movie, where signals of significantly different levels are mixed together with the goal of provided a specific aural experience. If the mix is sent to a compressor and improper gains are applied to the different sounds, then the auditory experience is negatively affected and is not the experience intended by the produce of the sound. In the case of music, the gain for each musical instrument is not correct, and the gain to one instrument might be quite different than it would be if the instrument were played in isolation. The impact is three-fold: the loudness of that instrument is not normal for the hearing aid listener (it may be too soft, for example), distortion to the temporal envelope of that instrument can occur, and interaural-level difference (ILD) cues for sound source localization and segregation can be distorted, making the perceived auditory image of that instrument fluctuate in a way that was not in the original recording.

Another example is when the accompanying instrumental tracks in a movie soundtrack have substantial energy then compression can overly reduce the overall level and distort the ILD of the simultaneous vocal tracks, diminishing the ability of the wearer to enjoy the mix of instrumental and vocal sound and even to hear and understand the vocal track. Thus, there is a need in the art for improved compression and mixing systems for hearing assistance devices and for external devices that stream audio to hearing assistance devices.

SUMMARY

This application relates to a systems and methods for enhanced dynamics processing of streaming audio by source separation and remixing for hearing assistance devices, according to one example. In one embodiment, an external streaming audio device applies compression or other processing to sources isolated from an audio signal using source separation, and mixes the resulting signals back into the unprocessed audio signal to enhance individual sources while minimizing audible artifacts. Variations of the present system use source separation in a side chain to guide processing of a composite audio signal.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their legal equivalents.

DETAILED DESCRIPTION

Figure 1:
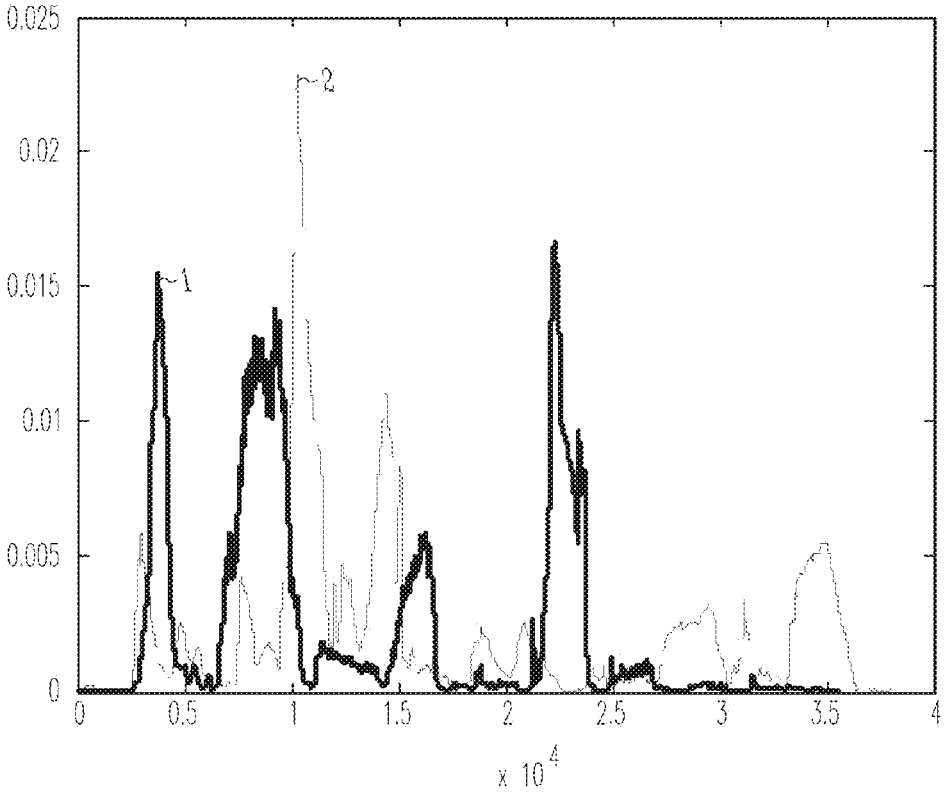
FIG. 1 shows the levels of two different sounds out of a filter centered at 1 kHz.
Figure 2:
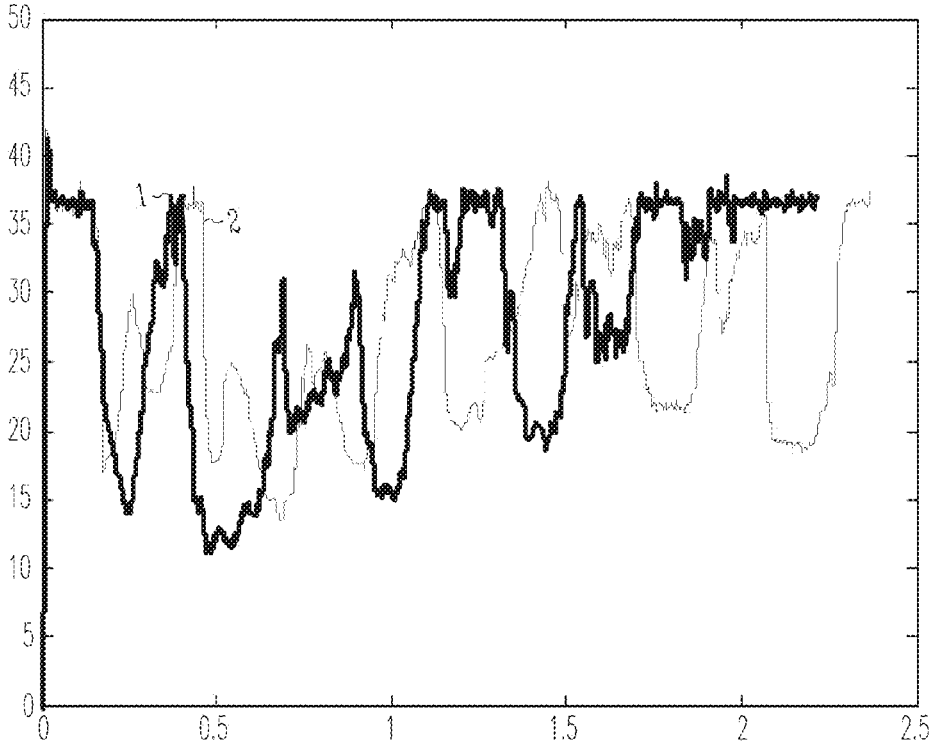
FIG. 2 shows the gains that would be applied to those two different sounds of FIG. 1 at 1 kHz if they were to be presented to a hypothetical multiband dynamic range compressor.
Figure 3:
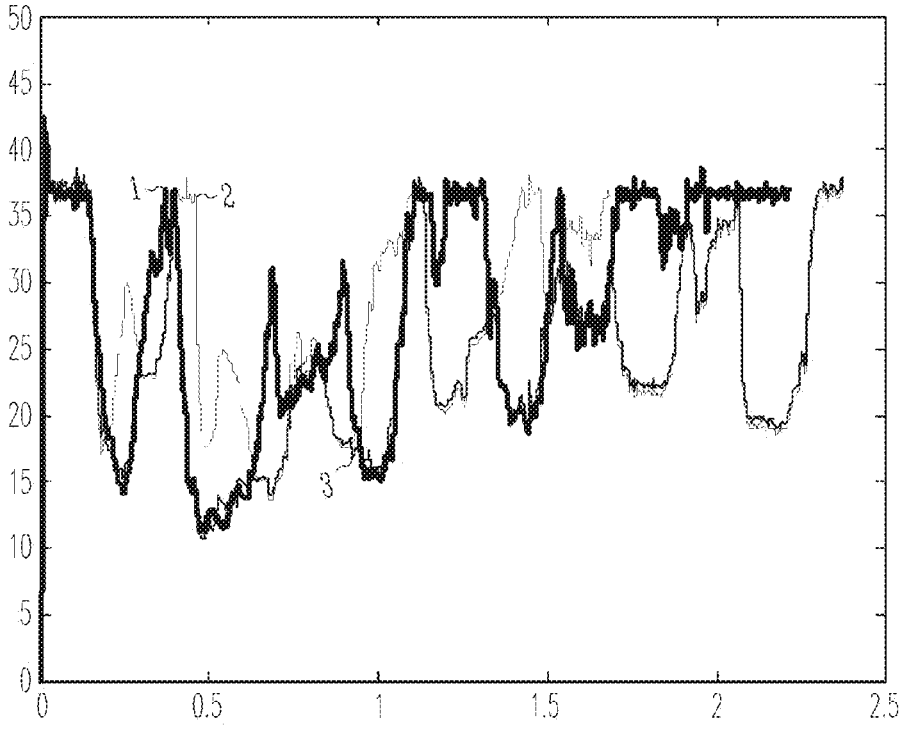
FIG. 3 shows the two gains from FIG. 1 represented by the thick line and the thinner line, but with a line of intermediate thickness which shows the gain that is applied when the two sounds are mixed together before being sent to the multiband compressor.

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Hearing assistance devices include the capability to receive audio from a variety of sources. For example, a hearing assistance device may receive audio or data from a transmitter or streamer from an external device, such as an assistive listening device (ALD). Data such as configuration parameters and telemetry information can be downloaded and/or uploaded to the instruments for the purpose of programming, control and data logging. Audio information can be digitized, packetized and transferred as digital packets to and from the hearing instruments for the purpose of streaming entertainment, carrying on phone conversations, playing announcements, alarms and reminders. In one embodiment, music is streamed from an external device to a hearing assistance device using a wireless transmission. Types of wireless transmissions include, but are not limited to, 802.11 (WIFI), Bluetooth or other means of wireless communication with a hearing instrument.

Streaming entertainment audio like music and movies can be acoustically dense, with many simultaneous sources and a relatively high degree of dynamic range compression. Conventional hearing aid signal processing may not be able to improve the clarity, intelligibility or sound quality of these signals, and may in fact degrade them by introducing significant cross-source modulation in which strong source drive the compression of weaker sources. Previous solutions to this problem include using more compression channels to reduce the amount of cross-source modulation by reducing the number of frequency components in each compression channel, thereby reducing the likelihood that components from two separate sources would be processed in the same channel. However, independent processing of components from a single source can impair perceptual fusion by reducing the amount of within-source co-modulation, or common modulation, which promotes perceptual fusion across frequency. This may facilitate component-specific processing, but not source-specific processing. Moreover, especially in music signals, it is common for several consonant (as opposed to dissonant) source to produce components that are very close in frequency and not resolvable even with a large number of compression channels.

The present subject matter relates to a systems and methods for enhanced dynamics processing of streaming audio by source separation and remixing for hearing assistance devices, according to one example. In one embodiment, an external streaming audio device applies processing (such as compression, in an embodiment) to sources isolated from an audio signal using source separation, and mixes the resulting processed signals back into the unprocessed audio signal to enhance individual sources while minimizing audible artifacts. Variations of the present system use source separation in a side chain to guide processing of a composite audio signal.

Various aspects of the present subject matter apply musical source separation to isolate individual voices and instruments in a mix and apply optimal source-specific gain processing before remixing. In various embodiments, a remix is automatically provided that is customized to compensate for the hearing loss of the wearer of a hearing assistance device. In one embodiment, each source in a mix receives optimal gain and compression, in a way that is not possible when compression is applied to the entire mixture. The hearing impaired listener is presented with a new mix that is optimized to compensate for their impairment. Because the sources are processed independently, degradations due to cross source modulation are minimized.

When applying compression to an audio mixture (or audio signal), each source in the mixture is compressed independently, such that each source receives gain that is optimal and appropriate without interference or corruption from other components of the mixture. The present subject matter applies compression to sources isolated from a mixture using source separate techniques, and mixes the compressed sources back into the unprocessed signal to enhance individual sources while minimizing audible artifacts. Various techniques can be used for audio source separation, as shown in the filed of computational auditory scene analysis (CASA). In one embodiment, a method using non-negative matrix factorization is used for source separation. Other methods can be used without departing from the scope of the present subject matter. Available source separation techniques have problems in that they require latency and the sound quality of separated signals is degraded by artifacts. However, in the case of streamed music, latency constraints are relaxed, and thus signal processing can be done on the external streaming device. Source separation techniques operate outside of real time, but near enough to real time to run in a streaming device with acceptable latency. The resulting individual sources can be mixed back in with the original signal to mask artifacts and add enhancement without signal degradation or unnatural sounding artifacts.

Figure 9:
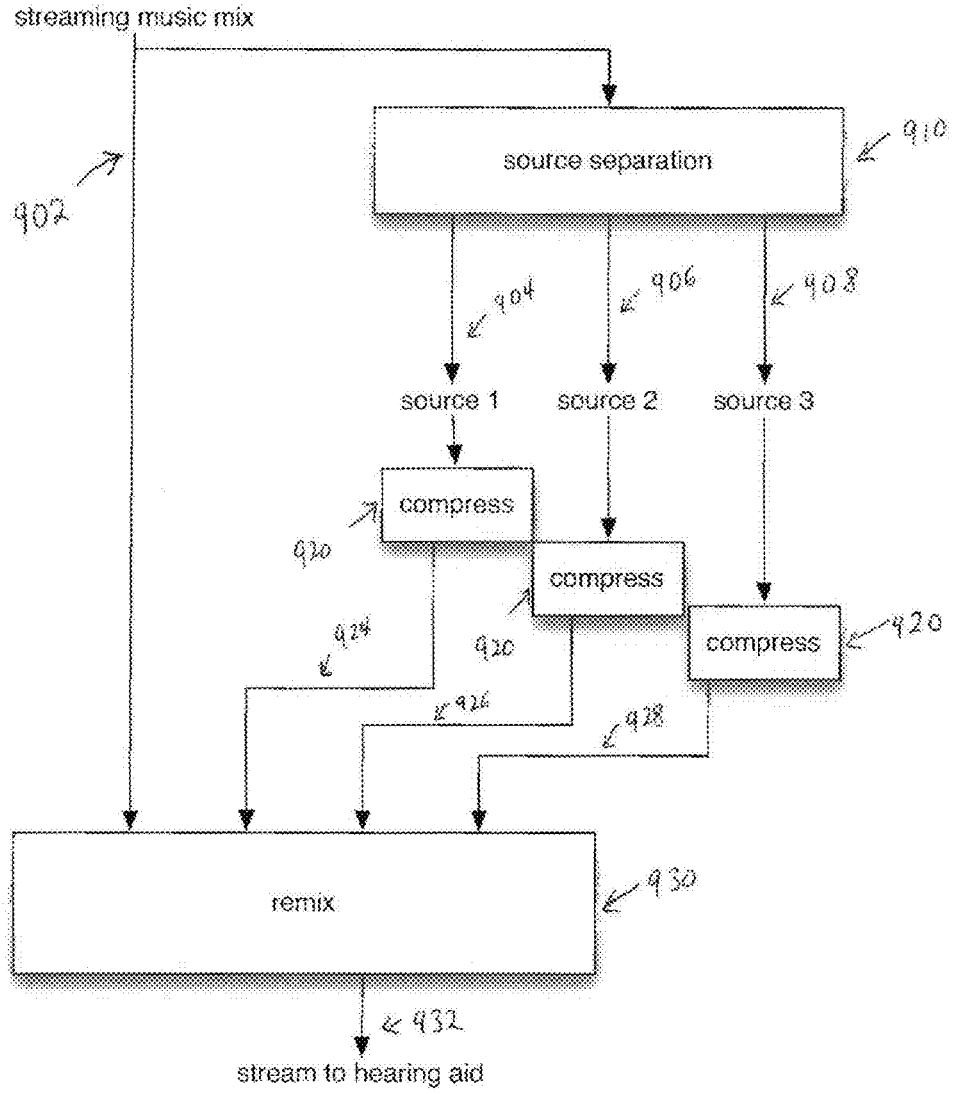
FIG. 9 shows a flow diagram for a streaming audio system, in which an audio signal is separated into component sound sources and compressed before being mixed with the unprocessed audio signal and streamed to a hearing assistance device, according to one embodiment of the present subject matter.

FIG. 9 shows a flow diagram for a streaming audio system, in which an audio signal is separated into component sound sources and compressed before being mixed with the unprocessed audio signal and streamed to a hearing assistance device, according to one embodiment of the present subject matter. Source separation 910 is applied to an incoming signal mixture 902 to obtain separate individual sound source components 904, 906, 908. The separate source components 904, 906, 908 are individually compressed 920 to obtain compressed to obtain compressed source components 924, 926, 928. After compressing the components, the compressed sound source components are mixed 930 with the audio signal (incoming signal mixture 902) to produce a mixed audio signal 932. According to various embodiments, the mixed audio signal 932 is streamed to a hearing assistance device worn by a wearer. The mixed audio signal provides a mix with the isolated sources appropriately compressed or enhanced, while artifacts due to imperfect source separation are masked, according to various embodiments. In various embodiments, the processing applied to the isolated source can be conventional hearing aid processing or other processing type. The audio signal 902 can be additionally processed in parallel with the isolated source before remixing, in an embodiment. The audio signal 902 is delayed to compensate for latency in source separation, in various embodiments.

According to other embodiments, source separation can be used in a side chain to guide processing of the composite audio signal 902. For example, the isolated sound sources (or characteristics of the isolated sound sources) can guide the tuning of a bank of resonant filters to enhance individual components in the composition signal. Other types of content- or context-specific processing can be guided by analysis performed on the segregated components, according to various embodiments. This enhancement mitigates artifacts due to imperfect source separation, since the isolated source would be used only for analysis, and would not be mixed back into the processed audio stream. The present subject matter provides improved clarity and sound quality in streamed music and audio, in various embodiments. The audio signals can be mono, stereo or multi-channel in various embodiments.

The present subject matter need not be limited to music or streaming audio. When combined with appropriate video buffering technology, this technique can be applied to streamed audio for movies and television, and can leverage multichannel (e.g. 5.1) mixing strategies, such as the mixing of speech to the center channel, to improve the source separation in various embodiments. Other signals can benefit from the present methods without departing from the scope of the present subject matter.

Figure 4:
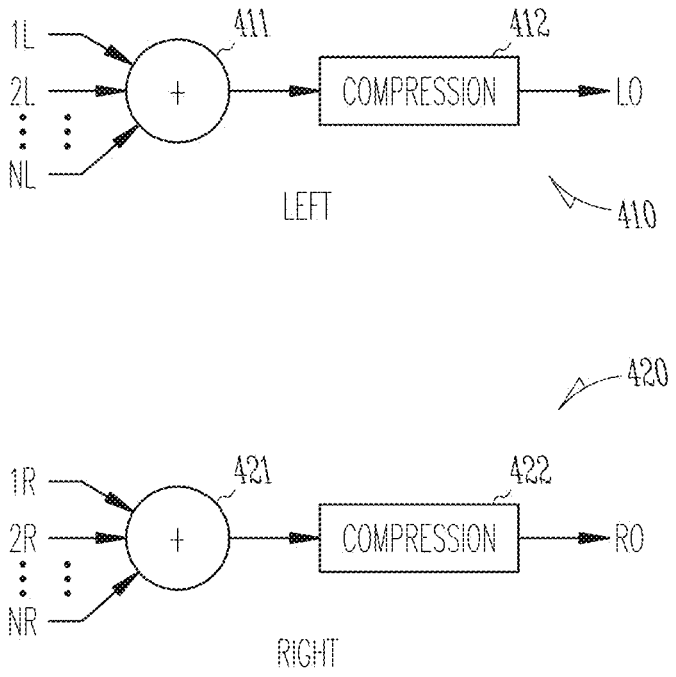
FIG. 4 illustrates a system for processing left and right stereo signals from a plurality of sound sources in order to produce mixed left and right sound output signals that can be used by left and right hearing assistance devices.

FIG. 4 illustrates a system for processing left and right stereo signals from a plurality of sound sources in order to produce mixed left and right sound output signals that can be used by left and right hearing assistance devices. The figure shows separate left 410 and right 420 channels where a plurality of left sound sources 1L, 2L, . . . , NL are mixed by mixer 411 to make a composite signal that is compressed using compressor 412 to produce the left output signal LO. FIG. 4 also shows in the right channel 420 a plurality of right sound sources 1R, 2R, . . . , NR that are mixed by mixer 421 to make a composite right signal that is compressed by compressor 422 to produce a right signal RO. It is understood that the separate sound sources can be right and left tracks of individual instruments. It is also possible that the tracks include vocals or other sounds. The system provides compression after the mixing which can result in over-attenuation of desired sounds, which is an undesired side effect of the signal processing. For example, if track 1 included bass guitar and track 2 included a lead guitar, it is possible that the louder instrument would dominate the signal strength in the channel at any given time and may result in over-attenuation of the weaker signal when compression is applied to the composite signal. Furthermore, because left and right signals are compressed independently, level difference between the left and right output signals LO and RO are compressed, i.e., ILD cues are reduced.

Figure 5:
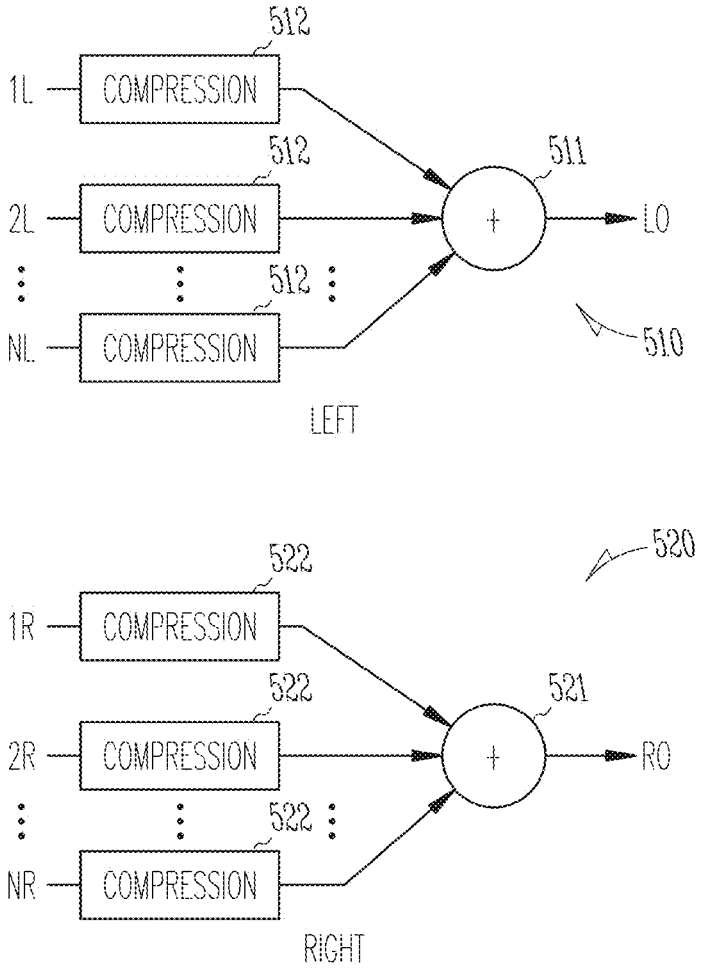
FIG. 5 illustrates a system for processing left and right stereo signals from a plurality of sound sources by applying compression before mixing to produce mixed left and right sound output signals that can be used by left and right hearing assistance devices according to one embodiment of the present subject matter.

FIG. 5 illustrates a system for processing left and right stereo signals from a plurality of sound sources by applying compression before mixing to produce mixed left and right sound output signals that can be used by left and right hearing assistance devices, according to one embodiment of the present subject matter. This embodiment applies compression (512 for the left channel 510 and 522 for the right channel 520) to each signal independently to assist in preserving the ability to mix each signal accordingly (using mixers 510 and 521, respectively). This approach allows each sound source 1L, 2L, . . . , NL and 1R, 2R, . . . , NL to be added to the composite signal as desired. It is understood that to provide a plurality of sound sources two or more sound sources are input into the mixer. These may be right and left components of an instrumental input, vocal input, or other sound input. Level difference between the left and right output signals LO and RO are compressed, i.e., ILD cues are reduced, because left and right signals are compressed independently.

Figure 6:
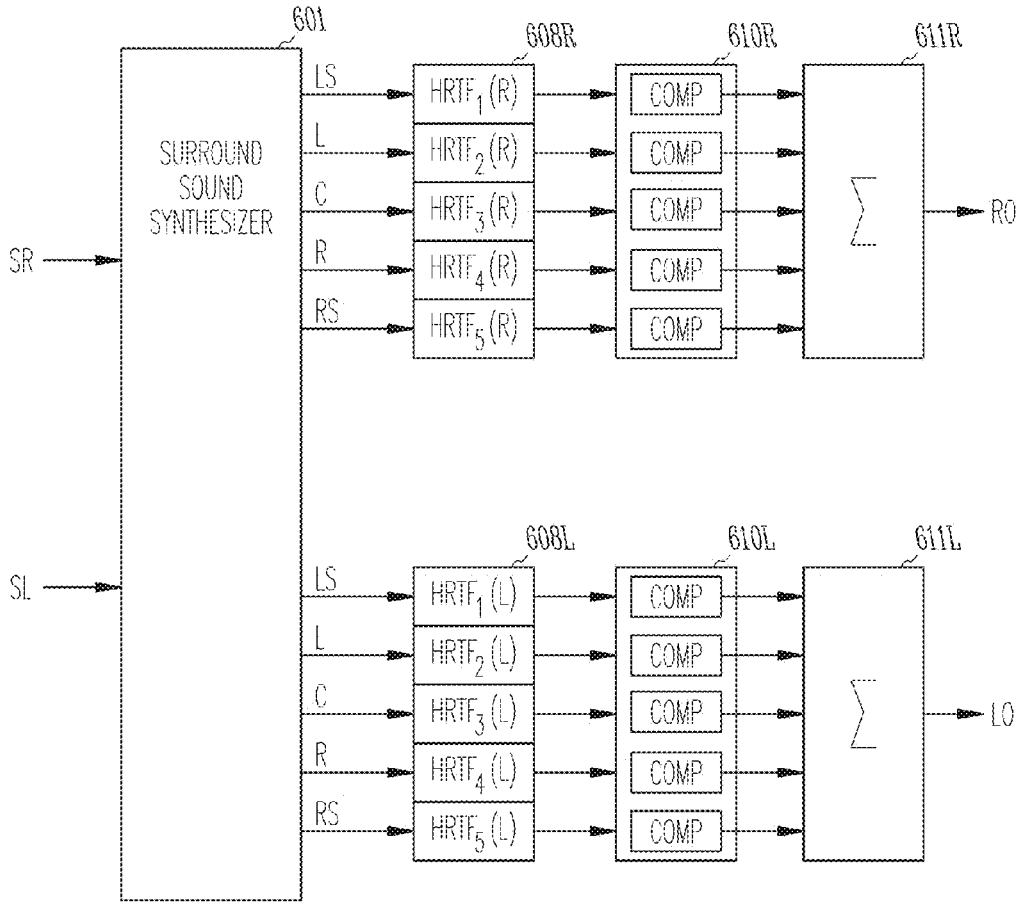
FIG. 6 shows one embodiment of a signal processor that includes a surround sound synthesizer for producing the surround sound signals from the left and right stereo signals where compression is applied the surround sound signals before mixing to produce mixed left and right sound output signals that can be used by left and right hearing assistance devices according to one embodiment of the present subject matter.

FIG. 6 shows one embodiment of a signal processor that includes a surround sound synthesizer for producing the surround sound signals from the left and right stereo signals where compression is applied the surround sound signals before mixing to produce mixed left and right sound output signals that can be used by left and right hearing assistance devices according to one embodiment of the present subject matter. A surround sound synthesizer 601 receives a right stereo signal SR and a left stereo signal SL and converts the signals into LS, L, C, R, and RS signals. In various embodiments, the HRTFs are not used and the signal passes from the surround sound synthesizer 601 to the compression stages 610R and 610L before being sent to the mixers 611 R and 611L. In various embodiments, the signals are processed by right and left head-related transfer functions (HRTFs) 608R and 608L. The resulting signals are then sent through compression stages 610R and 610L before being sent through mixers 611R and 611L. The resulting outputs RO and LO are used by the hearing assistance device to provide stereo sound reception. Level difference between the left and right output signals LO and RO are compressed, i.e., ILD cues are reduced, because left and right signals are compressed independently. It is understood that other surround sound systems may be employed without departing from the scope of the present subject matter. For example, surround sound systems include, but are not limited to Dolby 5.1, 6.1, and 7.1 systems, and the application of HRTFs is optional. Thus, the examples provided herein are intended to be demonstrative and not limiting, exclusive, or exhaustive.

One advantage of the system of FIG. 6 is that the center channel, which frequently is dominated by vocals, can be separated compressed from the other channels, which are largely dominated by the music. Such compression and mixing avoids cross modulation of gain. In various embodiments, the level of compression is commensurate with that found in hearing assistance devices, such as hearing aids. Other levels of compression are possible without departing from the scope of the present subject matter.

Figure 7:
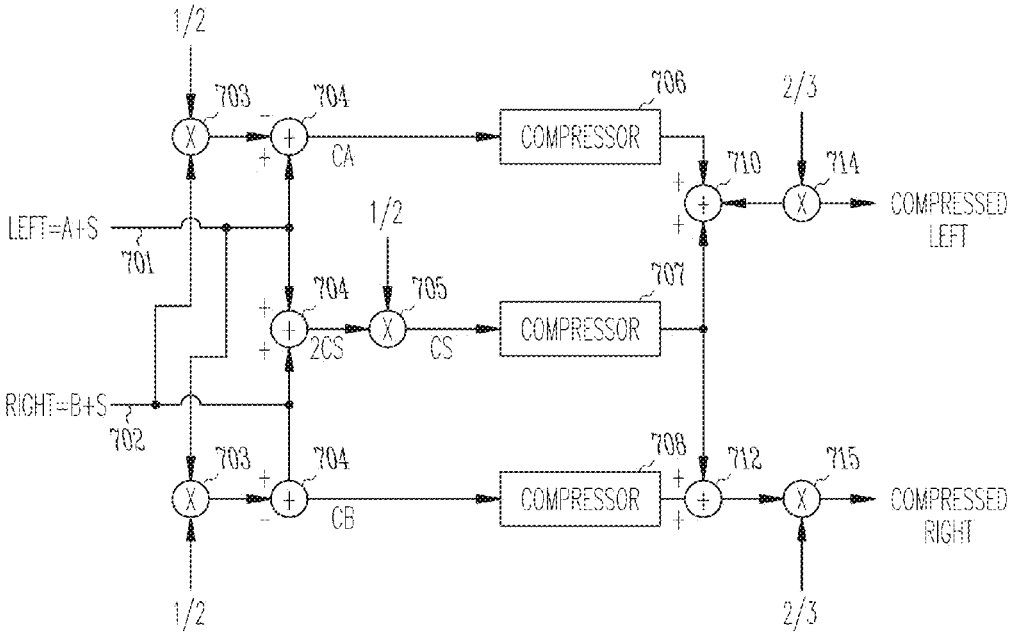
FIG. 7 shows an embodiment where a stereo music signal is processed to separate the center signal from the left-dominant and right-dominant signals in order to compress the center signal separately from the left-dominant and right-dominant signals, according to one embodiment of the present subject matter.

FIG. 7 shows one embodiment for separating a stereo signal into three channels for a more source-specific compression. Often in music, the signal for the singer is equally applied to both the left and right channel, centering the perceptual image of the singer. Consider the simple example of a stereo music signal with a singer S that is equally in the left and right channel, instrument A that is predominantly in the left channel, and instrument B that is predominantly in the right channel. Then, the left L and right R channels can be described as:

$$L=A+S$$

$$R=B+S$$

Then, one can remove the singer from the instruments by subtracting the left from the right channels, and create a signal that is dominated by the singer by adding the left and right channels:

$$L-R=(A+S)-(B+S)=A-B$$

$$L+R=(A+S)+(B+S)=A+B+2*S$$

$$CS=(L+R)/2=S+(A+B)/2$$

Thus, one can compress the (L+R)/2 mix to the compressor so that the gain is primarily that for the singer. To get a signal that is primarily instrument A and one that is primarily instrument B:

$$CA=L-R/2=(A+S)-(B+S)/2=A-(B-S)/2$$

$$CB=R-L/2=(B+S)-(A+S)/2=B-(A-S)/2$$

After CS, CL and CR have been individually compressed, they are mixed together to create a stereo channel again:

$$CL=2*(CS+CA)/3$$

$$CR=2*(CS+CB)/3$$

FIG. 7 is one example of how to combine the original channels before compression and how to mix the post-compressed signals back into a stereo signal, but other approaches exist. FIG. 7 shows the left (A+S) signal 701 and the right (B+S) signal 702 applied to multipliers (which multiply by ½) and summed by summers to create the CA, CB, and 2CS signals. The CS signal is obtained using multiplier 705. The CA, CB and CS signals are compressed by compressors 706, 708, and 707, respectively, and summed by summers 710 and 712. The resulting outputs are multiplied by ⅔ by multipliers 714 and 715 to provide the compressed left and compressed right signals, as shown in FIG. 7. It is understood that this is one example of how to process the signals and that other variations are possible without departing from the scope of the present subject matter. Thus, the system set forth in FIG. 7 is intended to be demonstrative and not exhaustive or exclusive.

Figure 8:
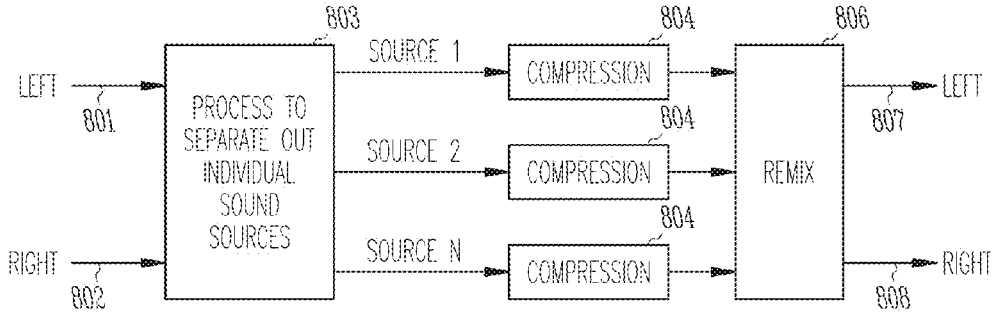
FIG. 8 shows an embodiment for separating sounds into component sound sources and compressing each individual sound source before being remixed into the original number of channels, according to one embodiment of the present subject matter.

FIG. 8 represents a general way of isolating a stereo signal into individual components that can then be separately compressed and recombined to create a stereo signal. There are known ways of taking a stereo signal and extracting the center channel in a more complex way than shown in FIG. 8 (e.g., U.S. Pat. No. 6,405,163, and U.S. Patent Application Publication Number 2007/0076902). Techniques can also be applied to monaural signals to separate the signal into individual instruments. With either approach, the sounds are separated into individual sound source signals, and each source is compressed; the individually compressed sources are then combined to create either the monaural or stereo signal for listening by the hearing impaired listener.

Left stereo signal 801 and right stereo signal 802 are sent through a process 803 that separates individual sound sources. Each source is sent to a compressor 804 and then mixed with mixer 806 to provide left 807 and right 808 stereo signals according to one embodiment of the present subject matter.

It is understood that the present subject matter can be embodied in a number of different applications. In applications involving mixing of music to generate hearing assistance device-compatible stereo signals, the mixing can be performed in a computer programmed to mix the tracks and perform compression as set forth herein. In various embodiments, the mixing is done in a fitting system. Such fitting systems include, but are not limited to, the fitting systems set forth in U.S. patent application Ser. No. 11/935,935, filed Nov. 6, 2007, and entitled: SIMULATED SURROUND SOUND HEARING AID FITTING SYSTEM, the entire specification of which is hereby incorporated by reference in its entirety.

Various embodiments of the present subject matter support wireless communications with a hearing assistance device. In various embodiments the wireless communications can include standard or nonstandard communications. Some examples of standard wireless communications include link protocols including, but not limited to, Bluetooth™, IEEE 802.11 (wireless LANs), 802.15 (WPANs), 802.16 (WiMAX), cellular protocols including, but not limited to CDMA and GSM, ZigBee, and ultra-wideband (UWB) technologies. Such protocols support radio frequency communications and some support infrared communications. Although the present system is demonstrated as a radio system, it is possible that other forms of wireless communications can be used such as ultrasonic, optical, and others. It is understood that the standards which can be used include past and present standards. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, ATM, Fibre-channel, Firewire or 1394, InfiniBand, or a native streaming interface. In various embodiments, such connections include all past and present link protocols. It is also contemplated that future versions of these protocols and new future standards may be employed without departing from the scope of the present subject matter.

It is understood that variations in communications protocols, antenna configurations, and combinations of components may be employed without departing from the scope of the present subject matter. Hearing assistance devices typically include an enclosure or housing, a microphone, hearing assistance device electronics including processing electronics, and a speaker or receiver. It is understood that in various embodiments the microphone is optional. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

In various embodiments, the mixing is done using the processor of the hearing assistance device. In cases where such devices are hearing aids, that processing can be done by the digital signal processor of the hearing aid or by another set of logic programmed to perform the mixing function provided herein. Other applications and processes are possible without departing from the scope of the present subject matter.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

It is understood that in various embodiments, the apparatus and processes set forth herein may be embodied in digital hardware, analog hardware, and/or combinations thereof. It is also understood that in various embodiments, the apparatus and processes set forth herein may be embodied in hardware, software, firmware, and/or combinations thereof.

This application is intended to cover adaptations and variations of the present subject matter. It is to be understood that the above description is intended to be illustrative, and not restrictive. The scope of the present subject matter should be determined with reference to the appended claim, along with the full scope of legal equivalents to which the claims are entitled.

What is claimed is:

1. A method, comprising:

isolating individual sound source components from an audio signal, including automatically isolating the components based on individual sound source;

independently processing the individual sound source components to compensate for hearing loss of a wearer of a hearing assistance device;

after processing the components, mixing the sound source components with the unprocessed audio signal to produce a mixed audio signal to minimize audible artifacts; and providing the mixed audio signal to the wearer using the hearing assistance device worn by the wearer.

2. The method of claim 1, wherein independently processing the individual sound source components includes independently compressing the individual sound source components.

3. The method of claim 1, wherein independently processing the individual sound source components includes applying source-specific gain processing to the individual sound source components.

4. The method of claim 1, wherein mixing the compressed sound source components includes providing a mix that is customized to compensate for the wearer's hearing loss.

5. The method of claim 1, wherein isolating individual sound source components from an audio signal includes using non-negative matrix factorization.

6. The method of claim 1, further comprising processing the audio signal in parallel with the isolated individual source components before mixing.

7. The method of claim 6, wherein processing the audio signal includes delaying the audio signal to compensate for latency in source separation.

8. The method of claim 1, wherein isolating individual sound source components from an audio signal includes processing to isolate voice and instrument components from musical signals.

9. The method of claim 1, wherein providing the mixed audio signal includes streaming the mixed audio signal to the hearing assistance device.

10. The method of claim 9, wherein streaming the mixed audio signal to a hearing assistance device includes streaming to a hearing aid.

11. A method, comprising:

isolating individual sound source components from an audio signal, including automatically isolating the components based on individual sound source;

analyzing the isolated sound source components to extract information from the isolated components;

processing the audio signal using the extracted information from the isolated sound sources to guide the processing; and providing the processed audio signal to a wearer using a hearing assistance device worn by the wearer.

12. The method of claim 11, wherein processing the audio signal includes using the information from isolated sound source to enhance individual components in the audio signal.

13. The method of claim 11, wherein using the information from the isolated sound sources includes using source identification.

14. The method of claim 11, wherein analyzing the isolated sound source components to extract information includes extracting features and characteristics of the sound source components.

15. The method of claim 11, wherein processing the audio signal using the information includes tuning a bank of resonant filters to enhance individual components in the audio signal.

16. The method of claim 11, wherein processing the audio signal using the information includes customizing to compensate for the wearer's hearing loss.

17. The method of claim 11, wherein isolating individual sound source components includes using non-negative matrix factorization.

18. The method of claim 11, wherein providing the processed audio signal to a wearer using a hearing assistance device includes using a hearing aid.

19. The method of claim 18, wherein using a hearing aid includes using a behind-the-ear (BTE) hearing aid.

20. The method of claim 18, wherein using a hearing aid includes using an in-the-ear (ITE) hearing aid.

* * * * *